US007591224B2

(12) United States Patent
Böck et al.

(10) Patent No.: US 7,591,224 B2
(45) Date of Patent: Sep. 22, 2009

(54) WEB-FED ROTARY PRESS AND METHOD FOR OPERATING IT

(75) Inventors: Thomas Böck, Neusäss (DE); Norbert Dylla, Stadtbergen (DE); Rudolf Eckert, Kissing (DE); Thomas John, Augsburg (DE); Wolfgang Käser, Mertingen (DE); Siegfried Schmid, Königsbrunn (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 13 days.

(21) Appl. No.: 11/807,781

(22) Filed: May 30, 2007

(65) Prior Publication Data

US 2007/0289466 A1 Dec. 20, 2007

(30) Foreign Application Priority Data

May 31, 2006 (DE) ..... 10 2006 025 264

(51) Int. Cl.
*B41L 35/14* (2006.01)

(52) U.S. Cl. ..... 101/488; 101/424.1

(58) Field of Classification Search ..... 101/488, 101/421.1

See application file for complete search history.

(56) References Cited

U.S. PATENT DOCUMENTS

| | | | | |
|---|---|---|---|---|
| 1,842,195 | A | 1/1932 | Pinder | |
| 3,122,999 | A | 3/1964 | Visser | |
| 3,960,081 | A * | 6/1976 | Gustavs et al. | 101/424.1 |
| 5,832,833 | A * | 11/1998 | Burgio | 101/424.1 |
| 6,109,184 | A * | 8/2000 | Wech | 101/487 |
| 6,178,883 | B1 | 1/2001 | Satoh et al. | |
| 6,745,688 | B1 * | 6/2004 | Lemelin et al. | 101/138 |
| 7,017,486 | B2 | 3/2006 | Steffen et al. | |
| 7,032,508 | B2 * | 4/2006 | Seymour | 101/211 |
| 7,316,184 | B2 * | 1/2008 | Schneider et al. | 101/424.1 |
| 2004/0177780 | A1 * | 9/2004 | Vroome | 101/228 |

FOREIGN PATENT DOCUMENTS

| | | |
|---|---|---|
| CH | 302932 | 11/1954 |
| DE | 34 29 079 | 3/1985 |
| DE | 39 39 368 | 6/1991 |
| DE | 100 08 658 | 8/2001 |
| EP | 0 947 318 | 10/1999 |
| EP | 1 457 324 | 9/2004 |

(Continued)

OTHER PUBLICATIONS

German Office Action dated Oct. 10, 2006 issued in corresponding application No. 10 2006 025 264.0.

(Continued)

*Primary Examiner*—Anthony H. Nguyen
(74) *Attorney, Agent, or Firm*—Cohen Pontani Lieberman & Pavane LLP

(57) ABSTRACT

A web-fed press includes at least two printing units and at least one drier for drying at least one printing-material web which is moved through the at least two printing units and printed on at least one side with at least one offset printing ink at each of the printing units. The printing-material web is dried at least after the first printing unit and before the second printing unit.

12 Claims, 3 Drawing Sheets

FOREIGN PATENT DOCUMENTS

| | | |
|---|---|---|
| GB | 28644 | 7/1915 |
| GB | 348760 | 5/1931 |
| GB | 919719 | 2/1963 |
| WO | WO 01/47252 | 6/2001 |
| WO | WO 2004/103705 | 12/2004 |

OTHER PUBLICATIONS

Search Report dated Sep. 24, 2007 issued in corresponding European Patent Application No. 07010543.2.

* cited by examiner

WEB-FED ROTARY PRESS AND METHOD FOR OPERATING IT

BACKGROUND OF THE INVENTION

1. Field of the Invention

The present invention relates to a web-fed rotary press having two printing units for printing a printing material web with at least one printing ink at each of the two printing units and at least one drier for drying the printing material web. The present invention also relates to a method for operating such a web-fed rotary press.

2. Description of the Related Art

Various ink systems with different types of drying behavior are used in web-fed rotary presses.

For example, coldset inks are known which are used principally together with absorbent newsprints. These inks dry by the oily constituents of the ink penetrating the papers. This process can be optionally assisted or accelerated by supplying heat.

Heatset inks, which are usually printed on coated papers, are dried under the influence of added heat. The oily constituents of the ink evaporate under the influence of the added heat and are usually suctioned off.

In another category of inks, the ink dries by a chemical reaction which is initiated by irradiation with electromagnetic radiation of a specific wavelength such as, for example, ultraviolet light.

In all cases, suitably designed driers can at least assist the process of ink drying. In the past, these driers have been installed downstream of the printing units.

The aforementioned types of printing inks can experience unwanted smearing or rubbing off. If, for example, in a printing unit that consists of two 9-cylinder satellites, the printing-material web is printed on one side with four inks in the first 9-cylinder satellite, the still wet printing ink on the surface of the impression cylinder of the second 9-cylinder satellite can rub off. For this reason, satellite units have not been used in the past when heatset inks are used. In the case of heatset inks and desired perfecting, blanket-to-blanket cylinder systems are preferably used in the printing units. However, ink smearing problems can arise even in this case with web guide elements, such as turner bars or guide rollers.

Another problem that arises in rotary offset printing is the fan-out effect. In the fan-out effect, the absorption of moisture causes an expansion of the width of the printing-material web. This expansion of the width of the printing-material web can lead to register differences, which can be reduced only by precise register adjustment and by electronic web control. If the distance between two printing units is large, this may even result in a tear of the wet and expanded printing-material web being guided between the two printing units.

SUMMARY OF THE INVENTION

An object of the present invention is to provide a web-fed rotary press and a method for operating a web-fed rotary press in which ink smearing and the fan-out effect no longer occur.

The inventors recognized that ink smearing or the fan-out effect can be avoided if the printing-material web is dried at least after the first printing with one or more inks and before it enters or passes through the next printing unit or a web guide element. The printing-material web can be printed on one side or both sides in one printing unit.

Therefore, the inventors propose that a web-fed press, which comprises at least two printing units arranged so that at least one printing-material web can be printed on one side or two sides with at least one offset printing ink at each printing unit, and which further comprises at least one drier for drying the one or more webs of printing material, be improved such that at least one drier is installed after the first printing unit and before the second printing unit.

If, for example, the web-fed press consists of two printing units, i.e., two 9-cylinder satellites, and if the printing ink is dried after the printing in the first 9-cylinder satellite, then ink smearing on the impression cylinder during passage through the second 9-cylinder satellite can be avoided. This allows the use heatset inks even in satellite units.

However, the new web-fed press is also advantageous with respect to the fan-out effect. If the printing-material web absorbs not only printing ink but also fountain solution after the first printing unit, and if it is then dried after the first printing unit, then the width expansion of the printing-material web and a tear in the web that could possibly result from the width expansion are avoided.

In one embodiment, at least one drier is installed after each printing unit. In this way, the ink that has been applied to one or both sides of the printing material is dried after each printing operation.

The drying effect can be optimized by installing one drier for each printed side of the printing-material web.

In a further embodiment of the web-fed press, at least one drier is installed before each web guide element in the web-fed press to prevent the smearing of printing ink on web guide elements that are installed for guiding the printing-material web, such as turner bars, impression cylinders, or formers.

The drier may, for example, be designed as a UV drier or an infrared drier. When designed as a UV drier, it irradiates the printing-material web with electromagnetic radiation in a wavelength range below 400 nm. When designed as an infrared drier, it directs heat radiation or hot air onto the printing ink on the surface of the printing-material web.

In another embodiment of the invention, a cooling element can be installed after each drier. In this way, the input of heat into the printing units or printing towers by the driers, which has negative effects on the printing process, is reduced.

The cooling elements can be installed as separate units before, between, or after the printing units or printing couples. However, it is also possible to provide integrated cooling, in which the cooling elements are installed inside an impression cylinder, a blanket cylinder, a web guide element, or a printing tower of the web-fed press.

Furthermore, the drier may be accommodated in a housing and can be integrated in the printing towers of the web-fed press as a drier module before or after a printing unit or between two printing units.

The printing units of the web-fed press may each be designed as a pair of cylinders. Single-cylinder or multiple-cylinder satellite systems or even blanket-to-blanket cylinder systems may be realized.

In addition to the web-fed press, the inventors also propose a method for operating a web-fed press, in which at least one printing-material web is printed on one or both sides with at least one offset printing ink in at least two printing units, and the at least one printing material web is dried with at least one drier. In accordance with the invention, the printing-material web is dried at least after the first printing unit and before the second printing unit. This avoids undesired smearing and the fan-out effect.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
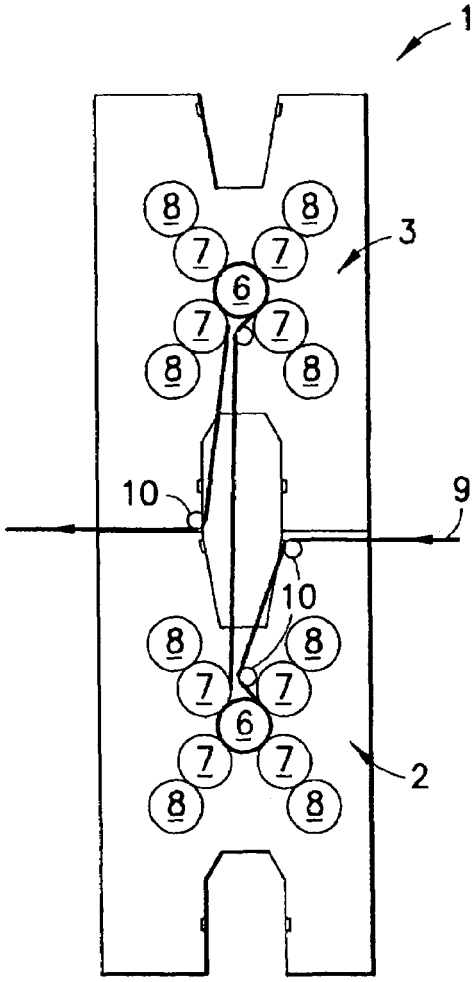
FIG.1 PRIOR ART
FIG. 1 is a schematic side view of a printing tower that consists of two nine-cylinder satellite units according to the prior art.

FIG. 1 shows a previously known printing tower 1 with two printing units. One or more such printing towers may be installed in a web-fed press. Each of the two printing units here is a nine-cylinder satellite unit 2, 3. To print with four inks, four pairs of cylinders, each consisting of a blanket cylinder 7 and a central impression or satellite cylinder 6, are engaged in each of the nine-cylinder satellite units 2, 3. Respective plate cylinders 8 adjacent to the blanket cylinders 7 carry the print image on printing plates. In a first nine-cylinder satellite unit 2, a first side of a printing-material web 9 is printed. In a second nine-cylinder satellite unit 3, a second side of the printing-material web 9 is printed. The printing-material web 9 is guided in and out or between the two printing units by web guide elements 10, such as guide rollers.

After the printing-material web 9 has been printed with four inks in the first nine-cylinder satellite unit 2, which is located at the bottom in FIG. 1, the printing-material web 9, which now has one side printed and rests on the surface of the impression or satellite cylinder 6, is printed on the second side. During this operation, the still wet printing ink of the printing-material web 9 may rub off on the surface of the impression/satellite cylinder 6. The design of a web-fed press in accordance with the present invention is intended to prevent this smearing of ink.

Figure 2:
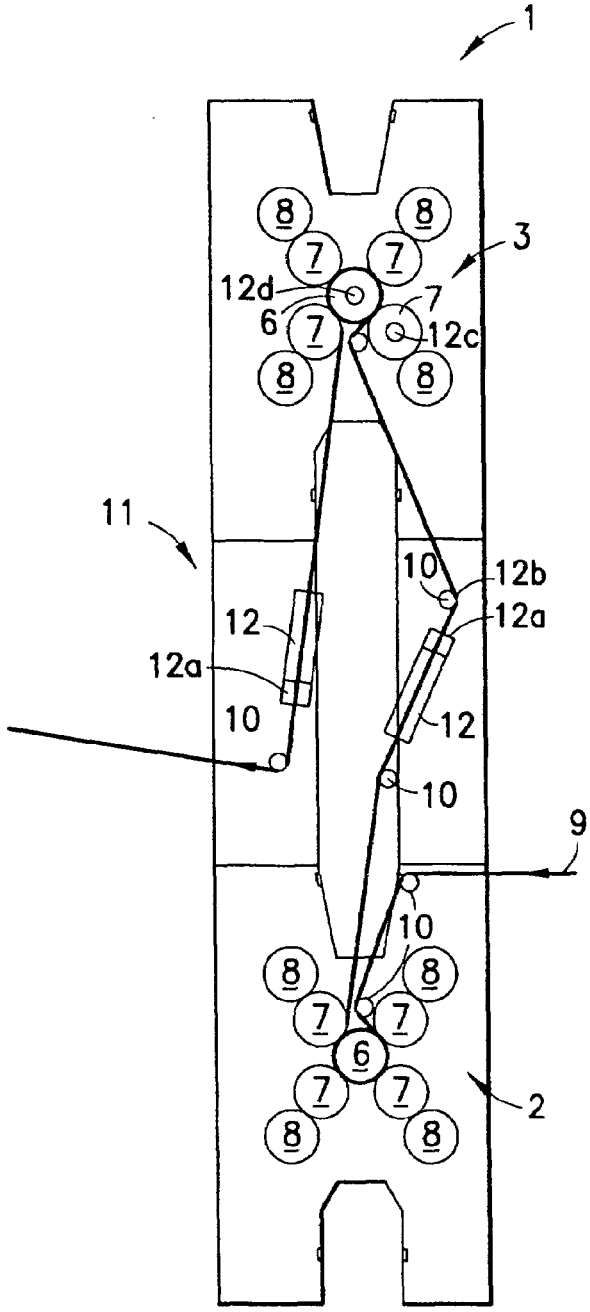
FIG. 2 is a schematic side view of a printing tower that consists of two nine-cylinder satellite units with a drier module according to an embodiment of the present invention.

FIG. 2 shows a printing tower 1 that consists of two nine-cylinder satellite units 2 and 3 (hereafter also referred to as printing units 2 and 3), with a drier module 11 installed between the housings of the printing units 2 and 3. The drier module 11 or its housing can be constructed in such a way that an existing printing tower 1 can be easily expanded. Two driers 12 are installed in the drier module 11 such that they are adapted to the existing web path of the printing-material web 9 within the printing tower 1 or, as shown in FIG. 2, in such a way that the web path is modified by web guide elements 10. In accordance with an embodiment of the present invention, it is also possible to integrate one or more driers 12 in an existing printing tower 1, such as the one shown in FIG. 1, in the vicinity of the web lead of the printing-material web between the printing units 2 and 3. The advantage of installing the driers 12 between two printing units is that the still wet ink on the printing-material web 9 is dried after leaving the first printing unit 2 and before entering the second printing unit 3. If one or more driers 12 are installed between the two nine-cylinder satellite units 2 and 3, the ink can no longer rub off on the impression cylinder 6 of the second nine-cylinder satellite unit 3. The driers 12 are, for example, UV driers or infrared driers that are adapted to the drying characteristics of the ink. To compensate for the input of heat from the driers 12 into the printing units, cooling elements 12*a* may be installed in the drier module 12 or in some other location in the printing tower 1, i.e., cooling element 12*b* in the web guide element 10 and cooling elements 12*d*, 12*c* in the blanket cylinder 7 and impression cylinder 6.

Figure 3:
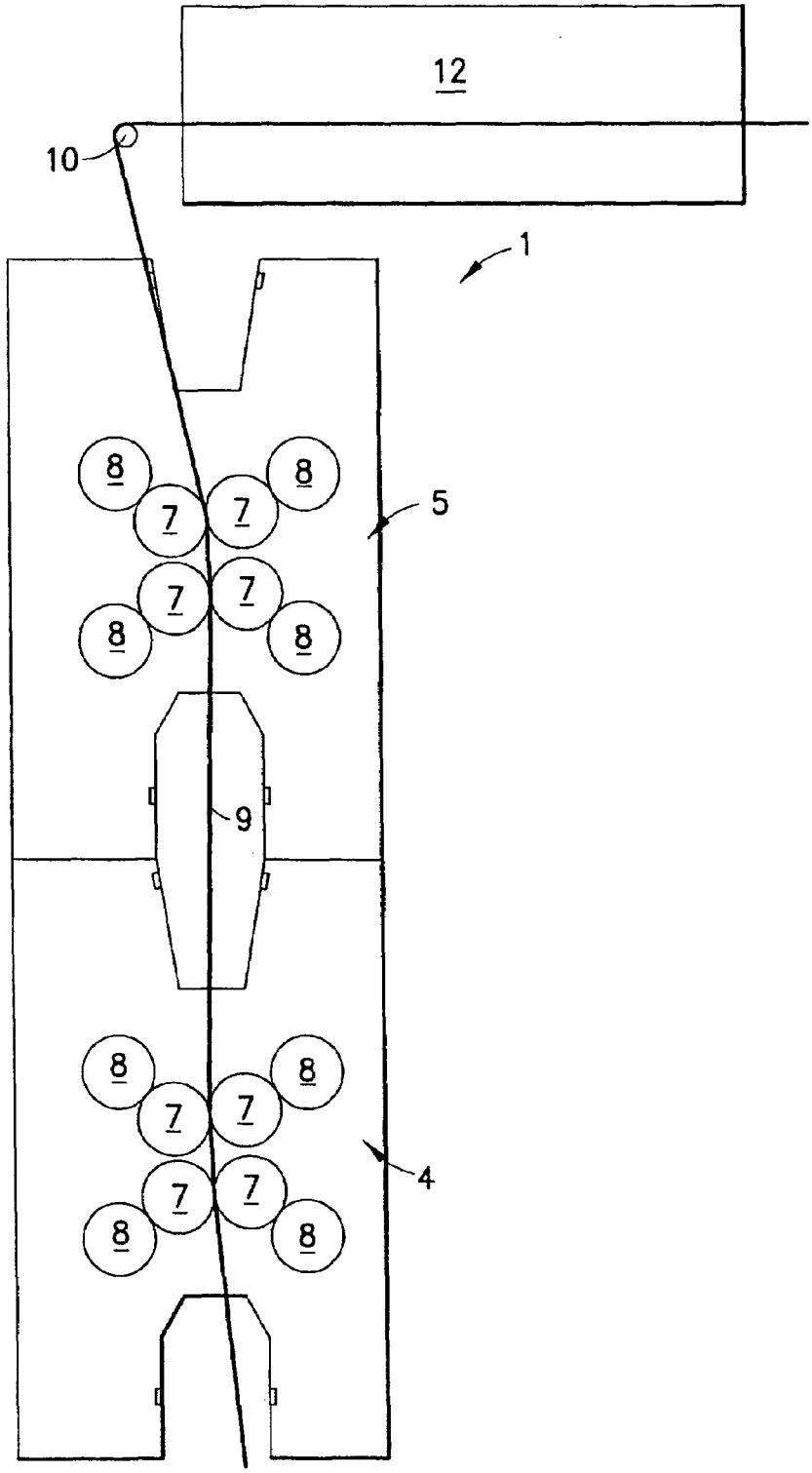
FIG. 3 is a schematic side view of a printing tower that consists of two double blanket-to-blanket cylinder printing units with a downstream drier according to another embodiment of the present invention.

FIG. 3 shows a previously known printing tower 1 with two printing units 4 and 5. One or more such printing towers 1 may be installed in a web-fed press. Each of the two printing units 4 and 5 here comprises two pairs of blanket cylinders 7, so that two inks can be applied to the printing-material web 9 in the perfecting process in each of the printing units 4 and 5. It is well known that when heatset inks are used, the heatset ink can be dried by a drier 12 installed downstream of the printing units. However, with this arrangement of printing tower 1 and drier 12, the fan-out effect and ink smearing on a web guide element 10 cannot be prevented.

Figure 4:
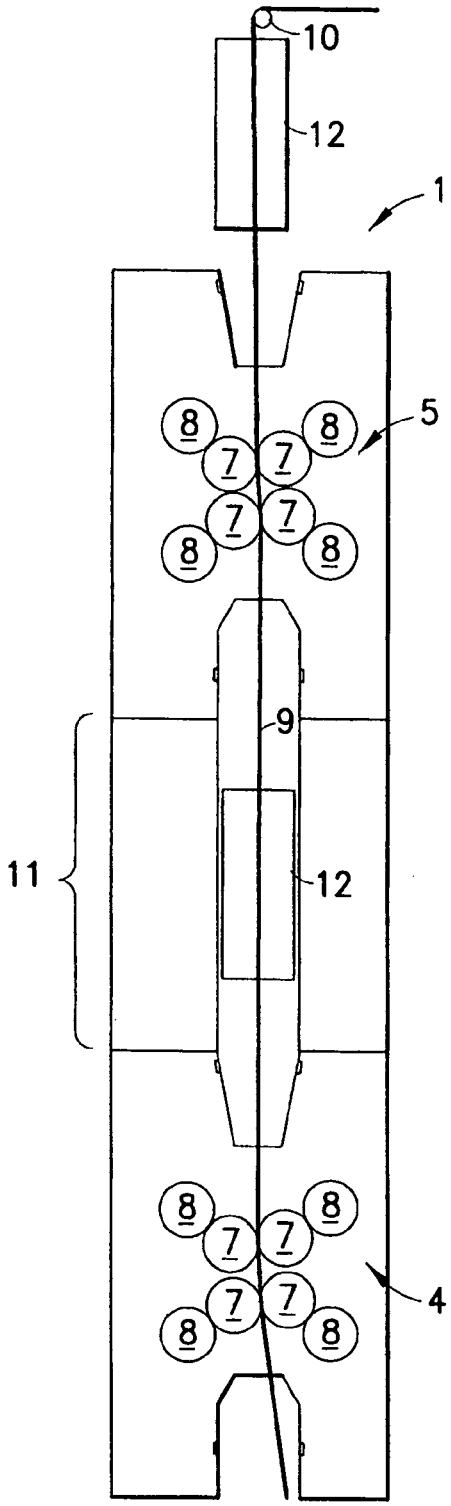
FIG. 4 is a schematic side view of the printing tower of FIG. 3 with a drier after each printing unit.

In the printing tower 1 shown in FIG. 4, a drier module 11 is installed between the printing units 4 and 5. It dries the wet printing-material web 9, which is printed on both sides, thereby preventing the fan-out effect and its negative consequences, such as web expansion or web tear. In addition, a further drier 12 is installed downstream of the second printing unit 5. It also dries the freshly printed printing-material web 9 and prevents ink smearing.

Figure 5:
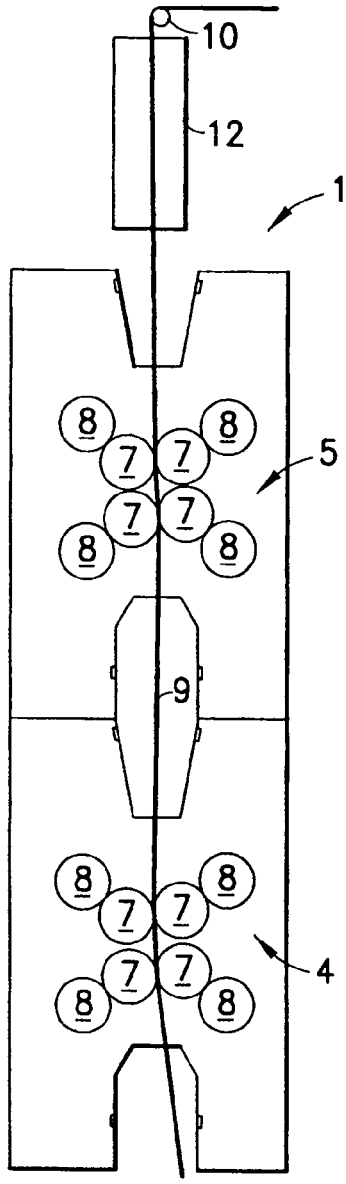
FIG. 5 is a schematic side view of the printing tower of FIG. 3 with a drier after the two printing units but before the web guide element.

FIG. 5 shows the printing tower 1 of FIG. 3. In this case, a drier 12 is installed after the two printing units 4 and 5 but before a web guide element 10. This special arrangement of the drier prevents ink from smearing on the web guide element 10. In a special embodiment of the invention, a drier 12 is installed on each side of the printing-material web 9 before each web guide element 10.

It is understood that the features specified above and the features specified in the claims can be used not only in the specified combinations but also alone or in other combinations without going beyond the scope of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A web-fed press, comprising:

at least first and second printing units arranged for printing on at least one side of a printing-material web fed there-through with at least one offset printing ink at each of said at least first and second printing units;

one of an impression cylinder and a web guide element;

at least one drier configured to dry the printing material web;

a blanket cylinder; and a cooling element installed downstream of each of said at least one drier;

wherein said at least one drier is installed after the first printing unit and before the second printing unit along a train of said printing material web such that said at least one offset printing ink is prevented from smearing one of said impression cylinder and web guide element; and wherein said cooling element is installed inside one of the impression cylinder, the blanket cylinder and the web guide element of the web-fed press.

2. The web-fed press of claim 1, wherein at least one drier is installed downstream of each of said at least first and second printing units.

3. The web-fed press of claim 1, wherein at least one drier is installed for each printed side of said printing-material web.

4. The web-fed press of claim 1, further comprising at least one web guide element arranged for guiding the printing-material web, wherein at least one drier is installed upstream of each web guide element.

5. The web-fed press of claim 1, wherein said drier is one of a UV drier or an infrared drier.

6. The web-fed press of claim 1, further comprising:

a printing tower; and a housing comprising a drier module integrated in said printing tower of the web-fed press downstream or upstream of one of said at least first and second printing units;

wherein said at least one drier is accommodated in the housing.

7. The web-fed press of claim 1, wherein each of said at least first and second printing units includes at least one pair of cylinders, wherein the at least pair of cylinders includes two blanket cylinders or an impression cylinder and a blanket cylinder.

8. A method for operating a web-fed press including an impression cylinder, a blanket cylinder and a web guide element, comprising the steps of:

printing at least one side of a printing-material web with at least one offset printing ink in at least first and second printing units;

drying the web of printing material with at least one drier after the first printing unit and before the second printing unit; and cooling the web at a cooling element installed downstream of each of said at least one dryer;

wherein said cooling element is installed inside one of the impression cylinder, the blanket cylinder and the web guide element of the web-fed press such that said at least one offset printing ink is prevented from smearing one of the impression cylinder and the web guide element of the web-fed press.

9. The method of claim 8, wherein said step of drying comprises drying the printing-material web after each of the at least first and second printing units.

10. The method of claim 8, wherein said step of drying comprises performing drying on each printed side of the printing-material web.

11. The method of claim 8, wherein said printing material web is guided over at least one web guide element, and said step of drying comprises drying the printing-material web before each web guide element that the printing material web is guided over.

12. The method of claim 8, wherein said step of drying comprises drying the printing-material web using ultraviolet or infrared radiation.

* * * * *